US009291057B2

(12) United States Patent
Benjamin et al.

(10) Patent No.: US 9,291,057 B2
(45) Date of Patent: Mar. 22, 2016

(54) TIE SHAFT FOR GAS TURBINE ENGINE AND FLOW FORMING METHOD FOR MANUFACTURING SAME

(75) Inventors: Daniel Benjamin, Simsbury, CT (US); Steve A. McLeod, Rocky Hill, CT (US); Daniel R. Kapszukiewicz, Plainfield, CT (US); Larry James Timmons, Middletown, CT (US); Paul D. Genereux, Stuart, FL (US)

(73) Assignee: UNITED TECHNOLOGIES CORPORATION, Hartford, CT (US)

( * ) Notice: Subject to any disclaimer, the term of this patent is extended or adjusted under 35 U.S.C. 154(b) by 268 days.

(21) Appl. No.: 13/551,675

(22) Filed: Jul. 18, 2012

(65) Prior Publication Data

US 2014/0023486 A1 Jan. 23, 2014

(51) Int. Cl.

| | |
|---|---|
| ***F01D 5/02*** | (2006.01) |
| ***B21D 22/16*** | (2006.01) |
| ***B21H 3/04*** | (2006.01) |
| ***C22F 1/10*** | (2006.01) |

(52) U.S. Cl.

CPC ..... *F01D 5/026* (2013.01); *B21D 22/16* (2013.01); *B21H 3/044* (2013.01); *C22F 1/10* (2013.01); *F01D 5/02* (2013.01); *F05D 2230/20* (2013.01); *F05D 2230/26* (2013.01); *F05D 2250/281* (2013.01); *F05D 2300/609* (2013.01); *Y10T 29/49234* (2015.01)

(58) Field of Classification Search

CPC ..... F01D 5/02; F01D 5/026; B21H 3/044; B21D 22/16

USPC ..... 72/370.01, 370.14, 96, 84, 85, 98

See application file for complete search history.

(56) References Cited

U.S. PATENT DOCUMENTS

| | | | | |
|---|---|---|---|---|
| 2,280,671 | A | 4/1942 | Stein | |
| 5,321,968 | A * | 6/1994 | Poole et al. | 72/306 |
| 5,339,669 | A | 8/1994 | Cretin et al. | |
| 5,882,161 | A | 3/1999 | Birkelbach | |
| 6,227,024 | B1 | 5/2001 | Koestermeier | |
| 6,904,779 | B1 * | 6/2005 | Hickok | 72/98 |
| 6,959,553 | B2 | 11/2005 | Anderson | |
| 6,972,115 | B1 | 12/2005 | Ballard | |

(Continued)

FOREIGN PATENT DOCUMENTS

KR 100981742 B1 9/2010

OTHER PUBLICATIONS

International Search Report and Written Opinion for International Application No. PCT/US2012/044962 completed on Sep. 2, 2013.

(Continued)

*Primary Examiner* — Shelley Self
*Assistant Examiner* — Mohammad I Yusuf
(74) *Attorney, Agent, or Firm* — Carlson, Gaskey & Olds, P.C.

(57) ABSTRACT

A method is disclosed for manufacturing a tie shaft for aero or land based gas turbine engine. The method includes flow forming a tie shaft preform to produce a tie shaft. In one example, the tie shaft includes a nickel alloy cylindrical wall having a length to diameter ratio of at least 6:1, wherein the diameter is an average outer diameter. The wall includes a minimum effective strain of 0.3 in/in (7.6 mm/mm), and a grain size is in the range of G4 to G16 per ASTM E112. The wall includes a roll formed threaded surface having a thread roughness of less than 1260 μin (32 microns).

13 Claims, 4 Drawing Sheets

(56) References Cited

U.S. PATENT DOCUMENTS

| | | | | |
|---|---|---|---|---|
| 7,485,044 | B2 * | 2/2009 | Briggs | B21J 5/12 464/16 |
| 8,475,711 | B2 * | 7/2013 | Wojcik | 419/23 |
| 2003/0018380 | A1 * | 1/2003 | Craig et al. | 623/1.15 |
| 2003/0019269 | A1 * | 1/2003 | Rolf | 72/85 |
| 2004/0065129 | A1 | 4/2004 | Rolf | |
| 2008/0148795 | A1 * | 6/2008 | Hayashi | 72/208 |
| 2009/0014082 | A1 * | 1/2009 | Cannaley | 72/352 |
| 2010/0236122 | A1 | 9/2010 | Fonte | |
| 2011/0011253 | A1 * | 1/2011 | Fonte | 89/14.05 |
| 2011/0088817 | A1 * | 4/2011 | Mitchell | 148/514 |
| 2011/0133449 | A1 * | 6/2011 | Mazzaferro et al. | 285/333 |
| 2011/0219781 | A1 | 9/2011 | Benjamin et al. | |
| 2012/0051919 | A1 * | 3/2012 | Stonitsch | F01D 5/02 416/204 A |
| 2012/0141294 | A1 * | 6/2012 | Fielding | F01D 5/026 416/244 R |
| 2012/0308428 | A1 * | 12/2012 | Forbes Jones et al. | 72/364 |

OTHER PUBLICATIONS

Partial EP Search Report for EP Application No. 13820469.8 completed Jul. 10, 2015.

International Preliminary Report on Patentability for International Application No. PCT/US2013/044962 mailed Jan. 29, 2015.

* cited by examiner

TIE SHAFT FOR GAS TURBINE ENGINE AND FLOW FORMING METHOD FOR MANUFACTURING SAME

BACKGROUND

This disclosure relates to a tie shaft for a gas turbine engine. The disclosure also relates to a flow forming manufacturing method for producing the tie shaft.

Gas turbine engines typically include multiple spools, which are constructed from forged titanium or nickel and/or steel alloy disks connected by a shaft that is also generally made of nickel or steel alloys. Typically, an oversize long solid forging is machined to provide the desired shaft contour on the interior and exterior surfaces. This requires extensive and costly machining. In addition, any required threads must be machined into the shafts to provide securing features.

SUMMARY

A method is disclosed for manufacturing a tie shaft for a gas turbine engine. The method includes flow forming a tie shaft preform to produce a tubular near net shape part.

In a further embodiment of any of the above, the tie shaft preform is a nickel alloy or steel alloy.

In a further embodiment of any of the above, the method includes melting the nickel alloy using vacuum induction melting and vacuum arc remelting or vacuum induction melting, electroslag remelting, and vacuum arc remelting to produce the tie shaft preform.

In a further embodiment of any of the above, the flow forming step includes engaging an outer surface of the tie shaft preform at one end with a roller and working the outer surface from the one end to an opposite end.

In a further embodiment of any of the above, the method includes the step of flow forming in either forward or reverse directions, or a combination of the two.

In a further embodiment of any of the above, the flow forming step includes imparting a minimum effective strain of 0.3 in/in (7.6 mm/mm) in the tie shaft flow-formed part.

In a further embodiment of any of the above, the flow forming step includes producing a grain size in the range of G4 to G16 per ASTM E112.

In a further embodiment of any of the above, the method includes the step of trimming opposing ends of the flow formed shape to produce a tie shaft length. The tie shaft has a length to diameter ratio of at least 6:1. The diameter is an average outer diameter.

In a further embodiment of any of the above, the tie shaft preform has a wall thickness. The flow forming step reduces the preform wall thickness by a minimum of 30%.

In a further embodiment of any of the above, the method includes the separate step of roll forming threads onto the tie shaft to produce a threaded surface.

In a further embodiment of any of the above, the threaded surface includes threads having asymmetrical flanks.

In a further embodiment of any of the above, the threads have a root radius larger than 0.010 inches (0.254 mm).

In a further embodiment of any of the above, the threaded surface has a thread roughness of less than 1260 μin (32 microns).

In one example, the tie shaft includes a nickel alloy cylindrical wall having a length to diameter ratio of at least 6:1, wherein the diameter is an average outer diameter. The wall includes a minimum effective strain of 0.3 in/in (7.6 mm/mm), and a grain size is in the range of G4 to G16 per ASTM E112. The wall includes a threaded surface having a thread roughness of less than 1260 μin (32 microns) on load flanks.

In a further embodiment of any of the above, the tie shaft includes multiple rotors that are secured to the cylindrical wall by a member that engages the threaded surface.

BRIEF DESCRIPTION OF THE DRAWINGS

The disclosure can be further understood by reference to the following detailed description when considered in connection with the accompanying drawings.

DETAILED DESCRIPTION

Figure 1:
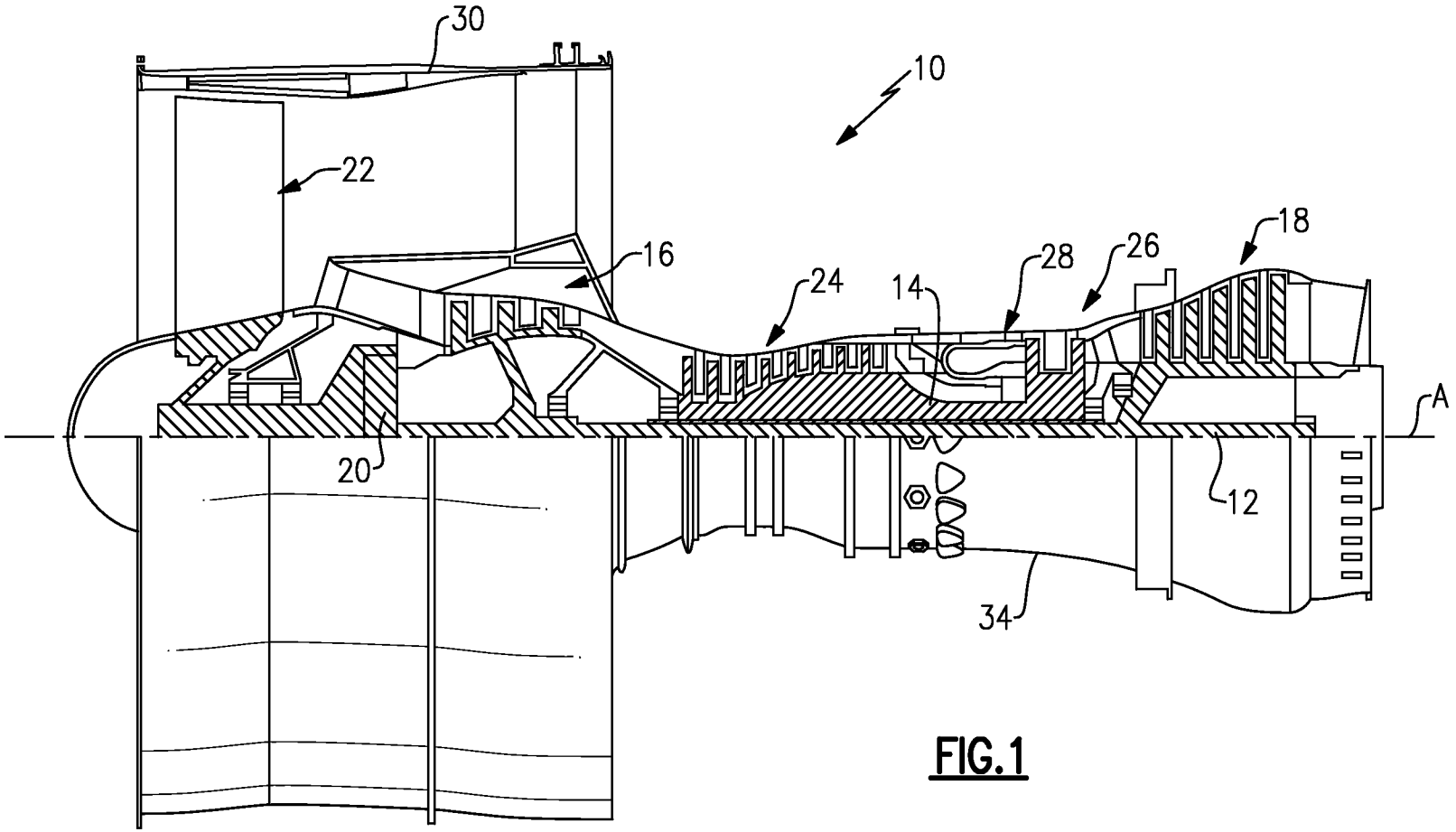
FIG. 1 is a schematic view of an example gas turbine engine.

One example gas turbine engine 10 is schematically illustrated in FIG. 1. The engine 10 includes low and high spools 12, 14. Although a two-spool arrangement is illustrated, it should be understood that additional or fewer spools may be used in connection with the disclosed tie shaft arrangement.

A low pressure compressor section 16 and a low pressure turbine section 18 are mounted on the low spool 12. A gear train 20 interconnects the low spool 12 to a fan section 22, which is arranged within a fan case 30.

A high pressure compressor section 24 and a high pressure turbine section 26 are mounted on the high spool 14. A combustor section 28 is arranged between the high pressure compressor section 24 and the high pressure turbine section 26. The low pressure compressor section 16, the low pressure turbine section 18, the high pressure compressor section 24, the high pressure turbine section 26 and the combustor section 28 are arranged within a core case 34.

Figure 2:
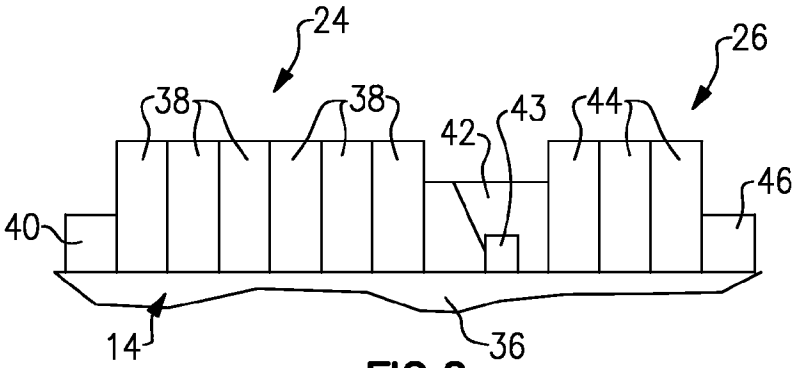
FIG. 2 is a highly schematic view of an example tie shaft arrangement.

The engine 10 illustrated in FIG. 1 provides an axial flow path through the core case 34. An example tie shaft arrangement for the gas turbine engine 10 is illustrated in FIG. 2. It should be understood that the tie shaft 36 can be used for other types of engines. A stack of high pressure compressor rotors 38 is retained by and clamped between first and second members 40, 42. The second member 42 may include a hub and/or a nut 43, for example. High pressure turbine rotors 44 are clamped between the second member 42 and a third member 46. The first, second and third members 40, 42, 46 are coupled by threads onto corresponding features on the tie shaft 36 in the example.

Figure 3:
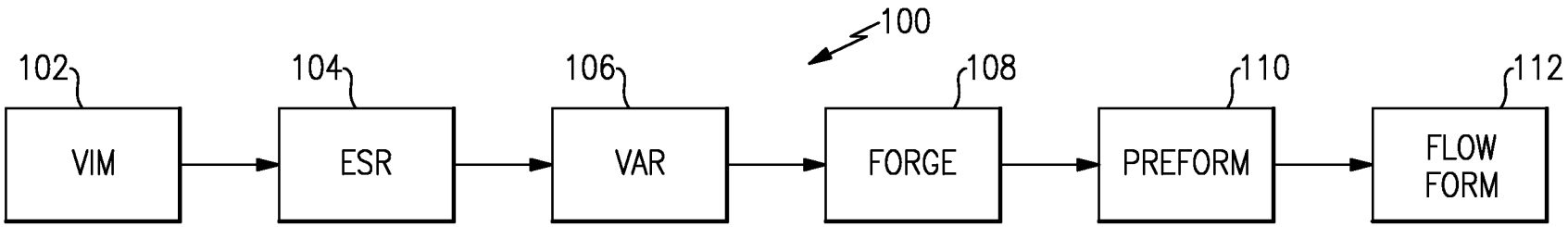
FIG. 3 is a flow chart depicting an example manufacturing process to produce a tie shaft flow formed shape.

Instead of using a typical forged alloy material with predominantly axial grain flow for the tie shaft 36, a material is produced that is more isotropic and therefore more suitable for the tie shaft application, according to a process schematically illustrated at 100 in FIG. 3. A nickel alloy, such as Inconel 718 is subjected to a triple melt process to produce smaller carbides in an alloy matrix and results in better distribution of the primary type carbides and less carbide stringering with a very consistent, controlled microstructure throughout the tie shaft's flow formed shape. Triple melt also provides improved homogenization and less melt segregation especially beneficial for larger shafts that require more aggressive processing like flow-forming. First, the nickel alloy is melted using a vacuum induction melt (VIM) process, as indicated at 102. The alloy then undergoes an electroslag remelt (ESR) process, as indicated at 104. The alloy is further processed using a vacuum arc remelt (VAR) process, as indicated at 106. Subsequently, the material may require forging 108 to produce a round billet of material with microstructure of ASTM G4 or finer grain size per ASTM E112. The billet is then machined to produce a tie shaft preform having a generally cylindrical tubular shape, as indicated at 110. A nickel alloy produced according to this process has reduced carbide particle size, reduced stringering of the carbides, and improved homogenization. Stringering is an alignment of carbides that can result from the flowform process. An etched metallographic cross-section of the material reveals linear-appearing carbides that look like a "string of carbides" in predominantly the axial direction. However, the carbides may also form in the circumferential direction. For some nickel alloys, a double melt process which consists of the vacuum induction melt followed by the vacuum arc remelt is sufficient to produce an acceptable preform for flow-forming at 112.

Figure 4B:
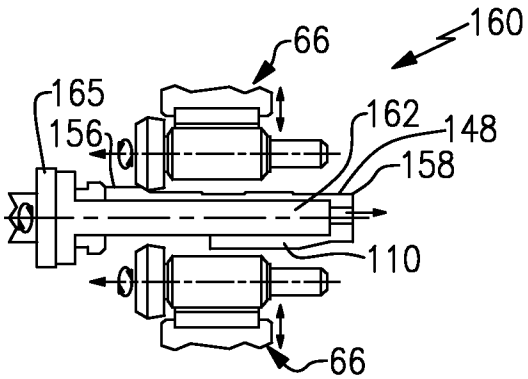
FIG. 4B is another example flow forming manufacturing process where rollers advance is opposite to the direction of material flow (i.e. reverse flow-forming).
Figure 4A:
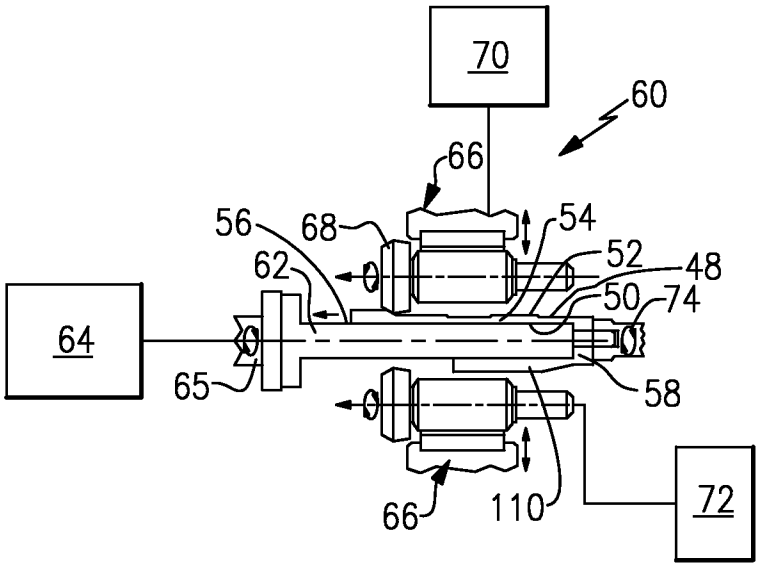
FIG. 4A is one example flow forming manufacturing process where rollers advance coincides with the direction of material flow (i.e forward flow-forming).

For comparison, FIGS. 4A and 4B illustrate preform 110 at the bottom of mandrel 62 and the flow formed preform shape 54 at the top of the mandrel 62.

Referring to FIG. 4A, an example flow forming process is schematically illustrated. A nickel alloy having a thicker preform shape 48 is flow-formed to provide a relatively thin wall tie shaft shape 54 which has inner and outer surfaces 50, 52. The tie shaft flow formed shape 54 extends between first and second ends 56, 58. The preform is sized such that its volume is close to the final volume of the flow-formed shape. Generally, this shape is also a more near net shape than can be achieved through conventional processing.

The tie shaft preform 110 is arranged over a mandrel 62 of a flow forming machine 60. The mandrel 62 is secured to a support 65 that is rotationally driven by a motor 64. In the example, the second end 58 is secured between the mandrel 62 and a clamp 74. The mandrel 62 may provide a generally constant inner diameter, for example.

Figure 5:
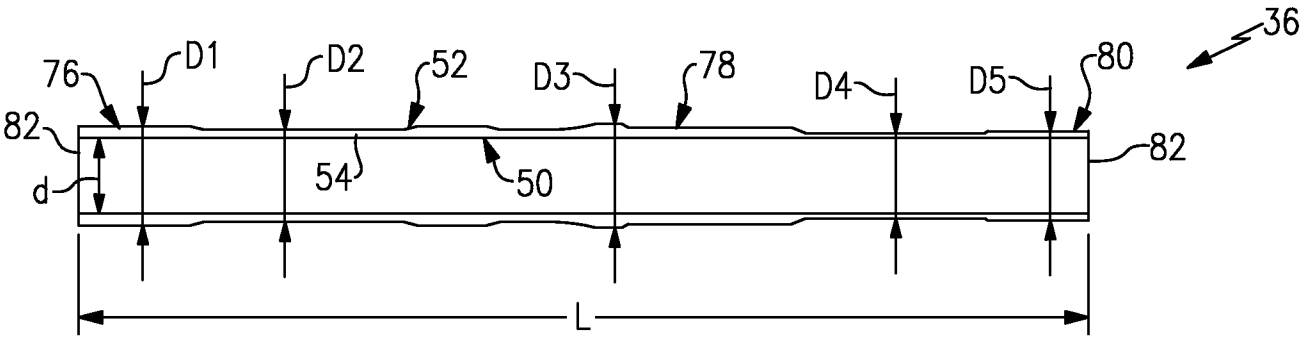
FIG. 5 is a cross-sectional view of an example tie shaft.

Two or more actuators 70, 66 move rolling members 72 axially and radially. The rolling members 72 include rollers 68 that engage the outer surface 52 of the preform 110. Rollers 68 can be either axially in line or axially staggered and/or radially staggered. In the example, the rollers 68 begin at the second end 58 and work the preform 110 towards first end 56. The combined axial and radial motion of the rollers 68 cold work the tie shaft preform 48 in a direction coincident with the advance of the rollers. The cold working of the material under the rollers causes adiabatic heating which increases the material ductility and aids in material deformation. Subsequent to flow forming, the first and second ends 56, 58 are trimmed to provide test material (outside the part shape), and a desired finish length L between ends 82 (FIG. 5). The flow forming process is capable of producing a tie shaft having a length/average outer diameter ratio of at least 6:1. In one example, the inner diameter is 3.75 in. (95.3 mm) and the average outer diameter is 3.95 in. (100.3 mm). This flow forming process is designed to reduce the wall thickness from preform to flow formed shape by a minimum of 30% of preform starting wall thickness or minimum effective strain of 0.3 in/in (7.6 mm/mm). This is required to limit undesirable "critical" grain growth.

Another flow forming machine 160 is illustrated in FIG. 4B. The mandrel 162 supports a preform 110, which is secured to the support 165. The second end 158 is unsupported relative to the mandrel 162. The rolling members 66 start at the second end 158 and work toward the first end 156 while the material flows in a direction opposite to the advance of rollers 66. In some cases where a transition microstructure is permissible, both forward and reverse flow-forming may be used and the combination of the two.

The flow formed tie shaft 36 is illustrated in more detail in FIG. 5. The inner surface 54 has an inner shape corresponding to the shape of the mandrel 62, in the example. A thickness of the wall 54 between the inner and outer surfaces 50, 52 is variable. In the example, first, second, third, fourth and fifth outer diameters D1, D2, D3, D4, D5 are provided.

Figure 7:
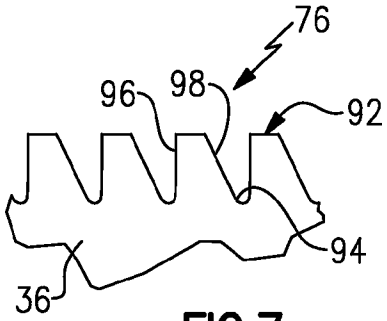
FIG. 7 is a schematic, cross-sectional view of example threads formed on the tie shaft.
Figure 6:
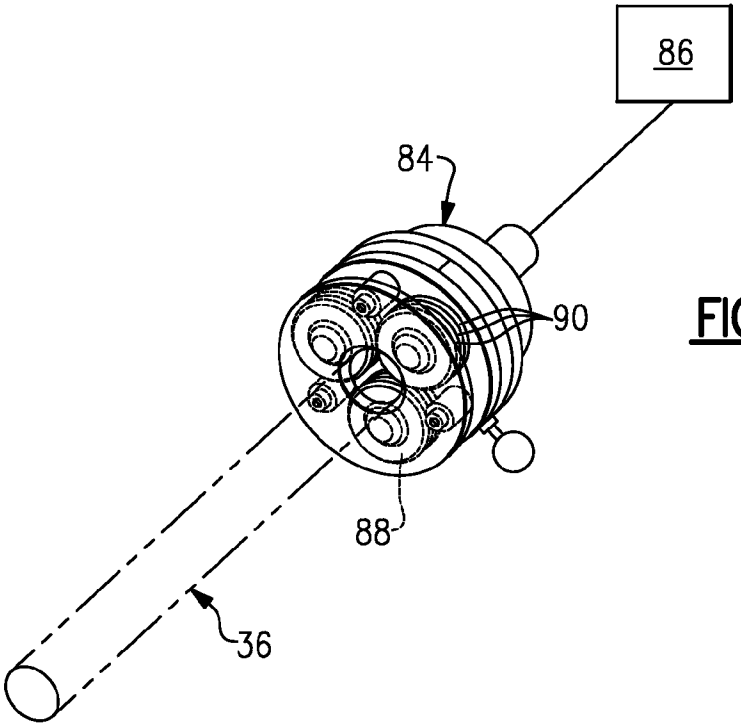
FIG. 6 is a schematic of an example thread rolling machine.

In one example, the outer surface 52 includes first, second, third threaded surfaces 76, 78, 80. The threaded surfaces are provided by a thread rolling tool 84, schematically illustrated in FIG. 6. A CNC machine 86 controls the thread rolling tool 84 to roll threads to provide the threaded surfaces 76, 78, 80. In one example, the thread rolling tool 84 includes multiple circumferentially arranged thread rollers 88 that each include rolling features 90 that correspond to a desired thread profile for the tie shaft 36. One example thread profile is illustrated in FIG. 7, which has asymmetrical thread form 92, although symmetrical threads may also be provided. The threads 92 include roots 94 having a root radius of larger than 0.010 inches (0.254 mm) and asymmetrical load and clearance flanks 96, 98.

The tie shaft 36 manufactured according to the example manufacturing processes described above includes a nickel alloy cylindrical wall 54 having a length to diameter ratio of at least 6:1, wherein the diameter is an average outer diameter. The wall 54 includes a minimum effective strain of 0.3 in/in (7.6 mm/mm), and a grain size in the range of, for example, G4 to G16 per ASTM E112, and in another example, G8 to G12. The process produces small particle sizes and extent of stringering, which is the primary life limiting feature. The wall 54 includes multiple threaded surfaces, for example, first, second, third threaded surfaces 76, 78, 80, having a thread roughness of less than 1260 μin (32 microns) over the load flanks. The flow forming and thread rolling process produces a finished tie shaft 36 having a near-net shape requiring minimal finish machining. Superior surface finish and a compressed layer on the threads ensure increased resistance to fretting and longer life. Flow formed barrels and rolled threads result in desired alignment of grain flow.

Although an example embodiment has been disclosed, a worker of ordinary skill in this art would recognize that certain modifications would come within the scope of the claims. For that reason, the following claims should be studied to determine their true scope and content.

What is claimed is:

1. A method of manufacturing a tie shaft for a gas turbine engine comprising:

melting a nickel alloy using vacuum induction melting;

vacuum arc remelting the nickel alloy to produce a tie shaft preform;

flow forming the tie shaft preform to produce a near net shape tie shaft, wherein the tie shaft preform has a wall thickness, the flow forming step reducing the preform wall thickness by a minimum of 30%; and rolling threads onto the tie shaft to produce a threaded surface, wherein the threaded surface has a thread roughness of less than 1260 μin.

2. The method according to claim 1, wherein the threaded surface includes threads having asymmetrical flanks.

3. The method according to claim 2, wherein threads have a root radius larger than 0.010 inches (0.254 mm).

4. The method according to claim 1, performing the step of electroslag remelting the nickel alloy after the vacuum induction melting step.

5. The method according to claim 1, wherein the flow forming step includes engaging an outer surface of the tie shaft preform at one end with a roller and working the outer surface from the one end to an opposite end.

6. The method according to claim 5, comprising the step of flow forming in either forward or reverse directions, or a combination of the two.

7. The method according to claim 1, wherein the flow forming step includes imparting a minimum effective strain of 0.3 in/in (7.6 mm/mm) in the tie shaft flow-formed part.

8. The method according to claim 7, wherein the flow forming step includes producing a grain size in the range of G4 to G16 per ASTM E112.

9. The method according to claim 1, comprising the step of trimming opposing ends of the tie shaft to produce a tie shaft length, the tie shaft having a length to diameter ratio of at least 6:1, wherein the diameter is an average outer diameter.

10. A method of manufacturing a tie shaft for a gas turbine engine comprising:

melting a steel alloy using vacuum induction melting;

vacuum arc remelting the steel alloy to produce a tie shaft preform;

flow forming the tie shaft preform to produce a near net shape tie shaft, wherein the tie shaft preform has a wall thickness, the flow forming step reducing the preform wall thickness by a minimum of 30%; and rolling threads onto the tie shaft to produce a threaded surface, wherein the threaded surface has a thread roughness of less than 1260 μin.

11. The method according to claim 10, performing the step of electroslag remelting the steel alloy after the vacuum induction melting step.

12. The method according to claim 10, wherein the flow forming step includes imparting a minimum effective strain of 0.3 in/in (7.6 mm/mm) in the tie shaft flow-formed part.

13. The method according to claim 12, wherein the flow forming step includes producing a grain size in the range of G4 to G16 per ASTM E112.

* * * * *